US008784017B2

(12) United States Patent
Ibarra et al.

(10) Patent No.: US 8,784,017 B2
(45) Date of Patent: Jul. 22, 2014

(54) DRILL BIT

(75) Inventors: Javier Ibarra, Schaumburg, IL (US); Hagen Dost, Chicago, IL (US); Jonathan Markwald, Elmhurst, IL (US); Michael Gong, Elk Groove, IL (US)

(73) Assignee: Robert Bosch GmbH, Stuttgart (DE)

( * ) Notice: Subject to any disclaimer, the term of this patent is extended or adjusted under 35 U.S.C. 154(b) by 917 days.

(21) Appl. No.: 12/878,392

(22) Filed: Sep. 9, 2010

(65) Prior Publication Data

US 2012/0063859 A1 Mar. 15, 2012

(51) Int. Cl.
*B27G 15/02* (2006.01)

(52) U.S. Cl.
USPC ..... 408/214

(58) Field of Classification Search
USPC ..... 408/211–214
IPC ..... B27G 15/00,15/02
See application file for complete search history.

(56) References Cited

U.S. PATENT DOCUMENTS

| | | | | |
|---|---|---|---|---|
| 781,652 | A * | 2/1905 | Hiatt | 408/213 |
| 808,245 | A * | 12/1905 | Lund | 408/201 |
| 996,612 | A * | 7/1911 | Caldwell | 408/102 |
| 1,244,593 | A * | 10/1917 | Doldt | 408/213 |
| 2,035,298 | A * | 3/1936 | Caldwell | 408/212 |
| 5,820,319 | A * | 10/1998 | Hull et al. | 408/214 |
| 6,612,788 | B2 * | 9/2003 | Thomas et al. | 408/214 |
| 7,267,513 | B2 * | 9/2007 | Wiker et al. | 408/214 |
| 2008/0166194 | A1 * | 7/2008 | Durfee | 408/214 |
| 2010/0307640 | A1 | 12/2010 | Durfee et al. | |

FOREIGN PATENT DOCUMENTS

| | | | | |
|---|---|---|---|---|
| DE | 29707504 | U1 | | 10/1997 |
| JP | 59007511 | A | | 1/1984 |
| JP | 2002210708 | A | * | 7/2002 |
| JP | 2006192820 | A | * | 7/2006 |
| JP | 2007296684 | A | * | 11/2007 |
| WO | 2004096471 | A2 | | 11/2004 |

OTHER PUBLICATIONS

JPO website machine translation of JP 2007-296684, printed Jun. 2013.*

JPO website machine translation of JP JP 2006-192820, printed Jun. 2013.*

International Search Report and Written Opinion in corresponding PCT application (i.e., PCT/US2011/061849), mailed Jun. 22, 2012 (15 pages).

Photo showing various auger bits; Publicly available at least as early as Sep. 8, 2010 (1 page).

Photo showing various wood screws; Publicly available at least as early as Sep. 8, 2010 (1 page).

* cited by examiner

*Primary Examiner* — Daniel Howell
(74) *Attorney, Agent, or Firm* — Maginot, Moore & Beck

(57) ABSTRACT

A drill bit for a boring tool comprises a shank configured for engagement with the boring tool and a working tip having a first end attached to the shank and an opposite second end, and a conical helical thread extending substantially continuously from end to end. The thread root may include a rounded portion while the crest may be flat. The configuration of the helical thread, such as the crest width, thread depth, thread angle, cross sectional area and base width are adjusted as a function of the length of the threaded working tip to maximize bending strength and optimize thread wear and operability.

18 Claims, 2 Drawing Sheets

DRILL BIT

BACKGROUND

The present disclosure relates to drill bits, such as bits for boring into wood. The disclosure particularly concerns the tip and thread configuration of drill bits.

Conventional drill bits generally mimic the thread configuration of common wood screws and bolts. In particular, the drill bit thread has a relatively thin cross section, which allows for larger gaps between threads to grip as much substrate as possible between threads. Thus, the typical drill bit has a sharp thin thread that is highly susceptible to damage should the bit encounter an obstruction within the substrate. For instance, it is not uncommon in the construction industry, and particularly in the housing construction industry, to encounter nail remnants or metal particles when boring into wood. This encounter can severely damage the tip and threads of the drill bit so that over time the bit is useless.

Another problem is that the typical drill bit is subjected to bending loads. Some of the bending load is exerted by encounters with obstructions while other loads are created by flexing of the boring tool when the bit is boring into the substrate. The sharp thin threads of the conventional drill bit are not able to withstand excessive bending loads or the stress concentrations that arise when encountering such loads. Under normal bending loads, traditional drill bits will experience tip breakage, thread wear and tip bending, which ultimately will render the bit useless.

SUMMARY

A drill bit for a boring tool comprises a shank configured for engagement with the boring tool and a threaded working tip having a first end attached to the shank and an opposite second end, and a helical thread extending substantially continuously from the first end to the second end. According to one feature, a first portion of the working tip is tapered at a first subtended angle and a second portion is tapered at a second subtended angle less than the first angle.

According to another feature, a drill bit comprising a shank and a threaded working tip includes a helical thread extending substantially continuously from the first end to the second end, the thread root having a rounded portion defined at a radius. The thread crest may be flat. A drill bit for a boring tool comprises a shank and a threaded working tip having a first end attached to the shank and an opposite second end, the working tip including a helical thread extending substantially continuously from the first end to the second end. In a further aspect, the thread has a width or thickness at the crest of the thread the magnitude of which may range from 0.01 mm to 1.0 mm depending upon the length of the tip. According to another feature, the magnitude of the thread depth may range from 0.5 mm to 1.55 mm depending upon the tip length.

In another aspect, the drill bit has a width at the base of the thread between crests, with the cumulative base width along the bit equal to a percentage range of the total tip length, depending upon the tip length. Further, the drill bit may include a thread pitch of 12-14 tpi. In yet another aspect, the total cross sectional area of the tip when the threads are formed is within a predetermined percentage range of the area of the non-threaded cone, depending upon the tip length.

DETAILED DESCRIPTION

Figure 1:
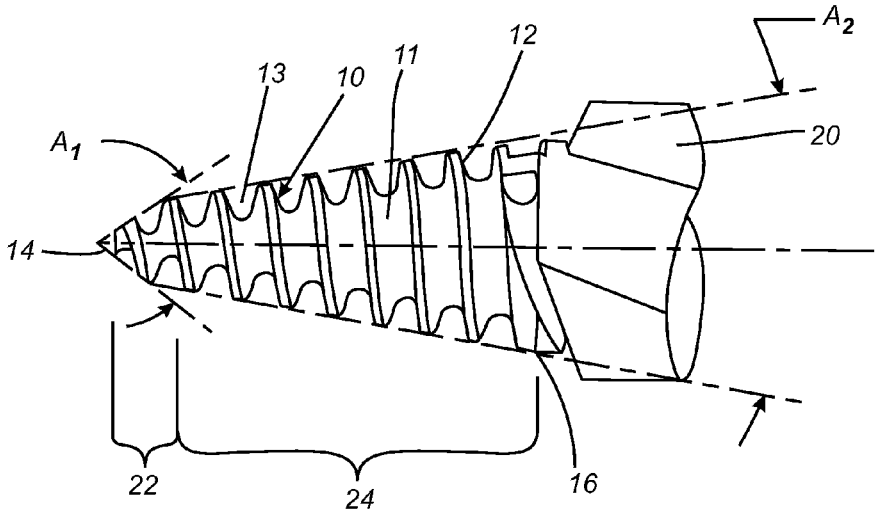
FIG. 1 is a side view of a drill bit as disclosed herein.

A drill bit 10 includes a continuous helical thread 12 extending from a first end 14 to a second end 16 of the bit body 11. The second end 16 is attached to a shank 20 or other feature suitable for engagement by a boring tool. The body 11 includes a first chamfer portion 22 extending from the first end 14 toward the second end 16, and a second portion 24 extending from the first portion to the second end 16.

In accordance with one feature, the chamfer portion 22 subtends an angle A1 originating at the first end 14 or the tip of the bit. Although the chamfer portion is not necessary for all embodiments, it is beneficial to reduce the thrust force required to penetrate the substrate while allowing the second portion 24 to have a larger cross section for greater bending strength. The second portion 24 subtends an angle A2 that is less than the angle A1. In other words, the portion of the bit at the tip is at a more aggressive angle than the remainder of the bit. The second subtended angle A2 may be about 30°. The magnitude of chamfer angle A1 may be in the range of 30° to 120°.

The aggressive angle of the portion 22 of the bit 10 provides a sharp tip for starting the engagement of the thread 12 with the substrate. However, the sharp tip angle A2 cannot be continued throughout the length of the threaded portion of the bit, otherwise the bit and resulting bore have an unusably large diameter. The smaller angle A2 of the second portion 24 of the bit facilitates optimal load dissipation along the bit.

Figure 2:
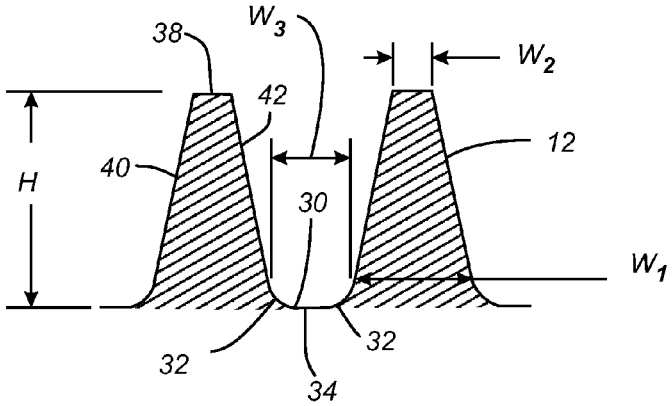
FIG. 2 is an enlarged cross-sectional view of the thread of the drill bit shown in FIG. 1

In the portion 24 the thread 12 has a height H from the root 30 to the crest 38 (FIG. 2). As shown in FIG. 1, the thread 12 has a constant height from the bit body 11 in the second portion 24 of the bit. The constant height ensures that the valley 13 formed by the thread is adequate to convey the material removed from the substrate as the bore is being created.

In another attribute, the thread 12 of the bit 10 is provided with a thicker, and therefore stiffer, crest in order to reduce bending, fatigue and wear of the thread. As depicted in FIG. 2, the thread 12 has a base width W1 at the root 30 and a crest width W2 at the crest 38. According to one aspect, the width W2 or crest thickness falls within a predetermined range depending upon the length of the tip or portion 24. For tip lengths between 7.0 mm and 13.9 mm the width W2 falls within the range 0.01 mm to 0.4 mm. For a tip length of 14.0 mm to 17.9 mm, the width W2 is in the range 0.01 mm to 0.6 mm. For larger tip lengths between 18 mm and 30 mm, the width W2 ranges from 0.01 mm to 1.0 mm. Thus, the thread 12 does not taper to a sharp edge as in prior drill bits, so the thread 12 disclosed herein has a much greater capacity to absorb impacts with nails and metal fragments embedded within a substrate being bored by the drill bit 10.

According to this feature, the thread angle and thread depth also vary as a function of tip length. For the shorter tip lengths of 7.0 mm to 17.9 mm the thread angle ranges from 10° to 45°. For larger tip lengths, from 18.0 mm to 30 mm, the lower end of the thread angle range can be reduced to 5°, for a thread angle range of 5° to 45°. The thread depth is a minimum 0.5 mm for all tip lengths, while the maximum thread depth varies with tip length. For instance, for tip lengths of: 7.0 mm to 11.9 mm, the maximum thread depth may be 1.25 mm; 12.0 mm to 13.9 mm, depth 1.35 mm; 14 mm to 17.9 mm, depth 1.5 mm; 18 mm to 21.9 mm, depth 1.55 mm; 22 mm to 25.9 mm, depth 1.6 mm; and 26 mm to 30 mm, depth 1.8 mm. The crest thickness, thread depth and thread angle relationships expressed above are believed to optimize thread wear resistance, gripping and tip stiffness.

The base width W1 of the teeth bears a relationship to the tip length. In particular, the cumulative base width W1 along the length of the tip is equal to about 50%-60% of the total tip length of the portion 24 for tip lengths ranging from 7.0 mm to 17.9 mm. Thus, if the tip length is 7.0 mm, the cumulative base width W1 may be in the range of 3.5 mm to 4.2 mm. For a tip length of 18 mm to 21.9 mm, the cumulative width W1 may be 40% to 60% of the total tip length, for tip lengths of 22 mm to 25.9 mm, the range is 30% to 55%, while for the larger length of 26 mm to 30 mm the cumulative root width W1 is 30% to 50% of the total tip length.

It can be appreciated that the root width W3 is the difference between the total tip length and the cumulative base width W1. For example, for a tip length of 7.0 m-11.9 mm in which the cumulative base width is 50-60% of the total tip length, the cumulative root width W3 is 40-50% of that length. Similarly, for the larger tip length of 26-30 mm, the cumulative root width can be 50-70% of the total tip length because the cumulative base width is 30-50%.

It has been found for the drill bits disclosed herein that a thread pitch of 12-14 tpi optimizes the performance of the drill bit 10. It has been further found that maintaining a certain cross-sectional area relationship for the drill bit provides an optimum trade-off between bending strength and gripping capability. Thus, in one aspect, a predetermined ratio is maintained between the cross sectional area of the non-threaded cone (as represented by the lines identifying the angle A2 in FIG. 1) relative to the cross-sectional area of the threaded tip, in which the predetermined ration varies according to tip length. Thus, for a tip length of 7.0 mm to 17.9 mm, the threaded tip has a cross-sectional area of 85%-95% of the cross-sectional area of the non-threaded cone. For a tip length of 18 mm to 21.9 mm, the relationship is 55% to 80%, while for the larger tip lengths of 22 mm to 30 mm the area relationship is 50% to 80%.

Figure 3:
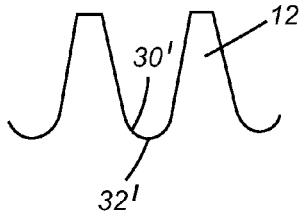
FIG. 3 is an enlarged view of an alternative thread root configuration for the drill bit of FIG. 1.

In another aspect, the drill bit 10 includes a root 30 having a rounded portion 32, as shown in FIGS. 2-3. In the embodiment shown in FIG. 2, the rounded portion 32 is interrupted by a flat portion 34. The flat portion 34 may have a width that is at least half the root width W3. In the embodiment shown in FIG. 3, the rounded portion 32' is continuous, forming the entire root 30'. The rounded portions 32, 32' are defined at a smooth radius between the root 30, 30' and the thread 12. The magnitude of the radius depends upon the thread angle and the base width W3, but will typically be about one-half the base width W3. For larger thread angles (around 45°) the rounder portion 32', for instance, may be more shallow and therefore at a radius that is greater than one half the base width W3. The rounded portion reduces stress concentration points or stress risers at the base of the thread that arise when the thread is subjected to bending loads upon encountering an obstruction during boring.

Figure 4:
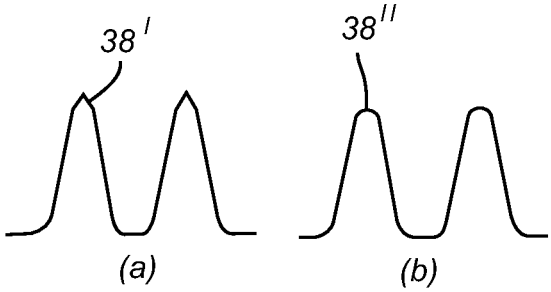
FIG. 4(*a*)-(*b*) are enlarged views of alternative thread crest configurations for the drill bit of FIG. 1.

The features described above can be incorporated into various thread configurations, as illustrated in FIGS. 4(*a*)-(*b*) and 5(*a*)-(*e*). In certain variations, the crest of the thread can be modified to form a "V" shape as shown in FIG. 4(*a*), or can be rounded as shown in FIG. 4(*b*). In both variations, the width of the thread at the crest is not compromised.

Figure 5:
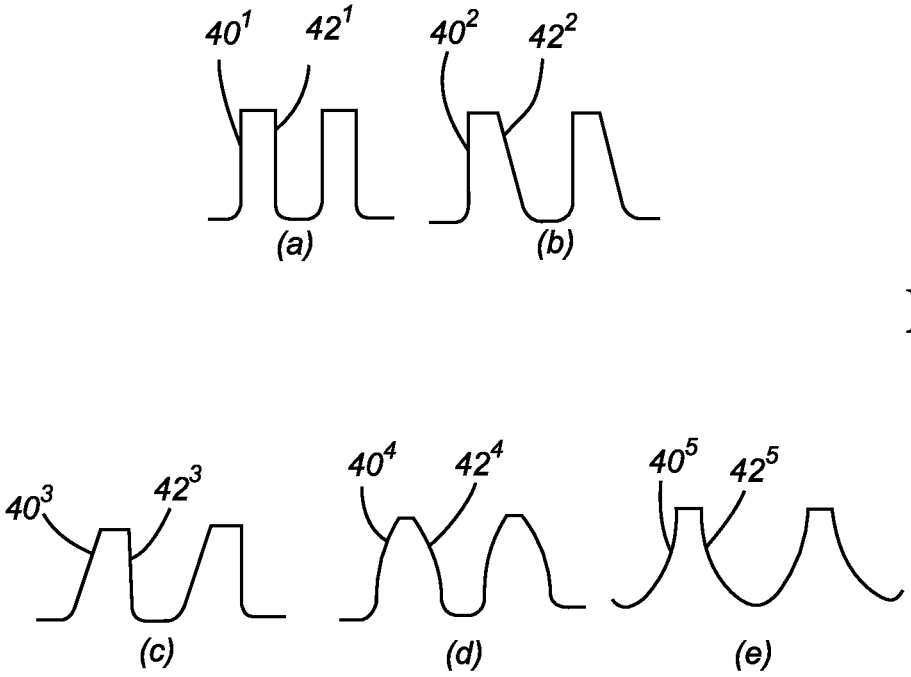
FIG. 5(*a*)-(*e*) are enlarged views of alternative thread profiles for the drill bit of FIG. 1.

The present features can accommodate various thread profiles as shown in FIGS. 2 and 5(*a*)-(*e*). As shown in FIG. 2, the leading flank 40 and trailing flank 42 of the thread 12 mutually converge from the root 30. Alternatively, the leading and trailing flanks $\mathbf{40}^1$, $\mathbf{42}^1$ are substantially parallel (FIG. 5(*a*)); one of the trailing flank $\mathbf{42}^2$ and the leading flank $\mathbf{40}^3$ is angled toward the other face $\mathbf{40}^2$, $\mathbf{42}^3$ (FIG. 5(*b*), (*c*)); the leading and trailing flanks $\mathbf{40}^4$, $\mathbf{42}^4$ are convexly curved (FIG. 5(*d*)); or the leading and trailing flanks $\mathbf{40}^5$, $\mathbf{42}^5$ are concavely curved (FIG. 5(*e*)). Again, in each of these variations the width of the thread at the crest is not compromised.

In accordance with the present disclosure, a method is provided for designing a drill bit that is configured to avoid damage when drilling through a substrate and encountering an object within the substrate. More particularly, the method relates to determining a thread design as a function of the length of the threaded working tip of the drill bit configured to reduce bending and thread wear and optimize drilling and material removal efficiency. Thus, as described above, the helical threads of the threaded working tip are provided with a pitch of 14 tpi and a crest having a width of at least 0.01 mm and a maximum width of 0.4 mm for a tip length of less than 14.0 mm, a maximum width of 0.6 mm for a tip length of between 14.0 mm and 17.9 mm, and a maximum width of 1.0 mm for a tip length of greater than 17.9 mm.

In another aspect of the method, the helical threads have a thread depth of greater than about 0.5 mm to a maximum of 1.25 mm for a tip length of less than 11.0 mm, a maximum of 1.35 mm for a tip length of between 11.0 and 13.9 mm, a maximum of 1.5 mm for a tip length of between 14.0 and 17.9 mm, maximum of 1.55 mm for a tip length of between 18.0 and 21.9 mm, a maximum of 1.6 mm for a tip length of between 22.0 and 25.9 mm, and a maximum of 1.8 mm for a tip length of greater than 25.9 mm.

The method further entails providing the helical thread with a thread angle of 10°-45° for tip lengths of less than 18.0 mm and an angle of 5°-45° for tip lengths of 18.0 mm and greater. In another step in the drill bit design, the threaded portion is conical and the cross sectional area of the body of the threaded portion is 60%-85% of the cross sectional area of the unthreaded subtended conical angle of the threaded portion for tip lengths of less than 18.0 mm, 55%-80% for tip lengths of 18.0 mm to 21.9 mm and 50%-80% for tip lengths greater than 21.9 mm. The threaded working tip of the drill bit is further designed so that the cumulative width of the base of the helical thread is 50%-60% of the tip length for tip lengths of less than 18.0 mm, 40%-60% for tip lengths between 18.0 mm and 21.9 mm, 30%-55% for tip lengths between 22.0 mm and 25.9 mm and 30%-50% for tip lengths greater than 25.9 mm. In accordance with the present method, the thread configuration of the drill bit is configured according to the above relationships with respect to the length of the threaded working tip.

What is claimed is:

1. A drill bit for a boring tool comprising:

a shank configured for engagement with the boring tool; and a threaded working tip having a first end attached to said shank and an opposite second end, said working tip including a helical thread extending substantially continuously from said first end to said second end, said helical thread having a root including a rounded portion defined at a radius, wherein said rounded portion of said root is interrupted by a flat portion interposed in said rounded portion.

2. The drill bit of claim 1, wherein said root has a width and said radius is equal to at least one half said width.

3. The drill bit of claim 1, wherein said helical thread has a pitch of between 12 and 14 tpi.

4. A drill bit for a boring tool, comprising:

a shank configured for engagement with the boring tool; and a threaded working tip having a first end attached to said shank and an opposite second end, said working tip including a helical thread extending substantially continuously from said first end to said second end, said helical thread having a root including a rounded portion defined at a radius, wherein said helical thread has a crest having a width of between a minimum width of 0.01 mm and maximum width of 1.0 mm.

5. The drill bit of claim 4, wherein said maximum width is 0.4 mm for a length of said threaded working tip of less than 14.0 mm.

6. The drill bit of claim 4, wherein said maximum width is 0.6 mm for a length of said threaded working tip of between 14.0 mm and 17.9 mm.

7. The drill bit of claim 4, wherein said maximum width is 1.0 mm for a length of said threaded working tip of greater than 17.9 mm.

8. The drill bit of claim 1 said helical thread has a thread depth of between a minimum depth of 0.5 mm and maximum depth of 1.8 mm.

9. The drill bit of claim 1, wherein said helical thread has a thread angle of less than a maximum of 45°.

10. The drill bit of claim 9, wherein said thread angle is greater than a minimum of 5°.

11. The drill bit of claim 10, wherein said thread angle is greater than a minimum of 10° for a threaded working tip having a length of less than 18.0 mm.

12. The drill bit of claim 1, wherein said helical thread has a crest that is peaked.

13. The drill bit of claim 1, wherein said helical thread has a crest that is rounded.

14. The drill bit of claim 1, wherein said helical thread has a leading flank and an opposite trailing flank and a cross-section defined by said leading and trailing flanks selected from the following configurations: the leading and trailing flanks mutually converge; one of the leading flank and the trailing flank is angled toward the other face; the leading and trailing flanks are substantially parallel; the leading and trailing flanks are convexly curved; and the leading and trailing flanks are concavely curved.

15. A drill bit for a boring tool, comprising:

a shank configured for engagement with the boring tool; and a threaded working tip having a first end attached to said shank and an opposite second end, said working tip including a helical thread extending substantially continuously from said first end to said second end, said helical thread having a root including a rounded portion defined at a radius, wherein said threaded working tip includes a threaded chamfer portion at said second end, said chamfer portion subtending an angle of between about 30° and 120°.

16. A drill bit for a boring tool comprising:

a shank configured for engagement with the boring tool; and a threaded working tip having a first end attached to said shank and an opposite second end, said working tip including a helical thread extending substantially continuously from said first end to said second end, said helical thread having a flat crest and a root including a rounded portion defined at a radius.

17. The drill bit of claim 16, wherein said rounded portion of said root is interrupted by a flat portion interposed in said rounded portion.

18. The drill bit of claim 16, wherein said crest has a width of between a minimum width of 0.01 mm and maximum width of 1.0 mm.

* * * * *